US006044652A

United States Patent [19]

Nishihara et al.

[11] Patent Number: 6,044,652

[45] Date of Patent: Apr. 4, 2000

[54] MULTI-ROOM TYPE AIR-CONDITIONER

[75] Inventors: Yoshikazu Nishihara; Keiji Nakao, both of Shiga; Hisao Kusuhara, Kyoto, all of Japan

[73] Assignee: Matsushita Electric Industrial, Japan

[21] Appl. No.: 09/171,046

[22] PCT Filed: Feb. 6, 1998

[86] PCT No.: PCT/JP98/00497

§ 371 Date: Oct. 7, 1998

§ 102(e) Date: Oct. 7, 1998

[87] PCT Pub. No.: WO98/35189

PCT Pub. Date: Aug. 13, 1998

[30] Foreign Application Priority Data

Feb. 7, 1997 [JP] Japan ..... 9-24903

[51] Int. Cl.[7] ..... F25B 7/00; F24F 3/00

[52] U.S. Cl. ..... 62/175; 62/229; 165/208

[58] Field of Search ..... 62/175, 228.4, 62/229; 165/205, 207, 208

[56] References Cited

FOREIGN PATENT DOCUMENTS 59-9443 1/1984 Japan .
61-11540 1/1986 Japan .
63-189750 8/1988 Japan .
3-17460 1/1991 Japan .
4-161764 6/1992 Japan .
6-123474 5/1994 Japan .

*Primary Examiner*—William Wayner
*Attorney, Agent, or Firm*—Rossi & Associates

[57] ABSTRACT

This invention aims to provide more comfortable air-conditioning and save energy by exerting capacity of an air-conditioning system responsive to requested capacities from plural rooms through the following process: first, establish a refrigerating cycle for a multi-room air-conditioning system, second, obtain data from differential temperature calculation means, capacity storing means, ON-OFF recognition means and load constant storing means, then calculate a compressor's capacity at a predetermined cycle, and provide compressor capacity control means which controls the capacity of variable capacity compressor based on the calculation result, and also provide operating unit recognition means which recognizes a number of operating units through the ON-OFF recognition means, finally, change a method of controlling the compressor capacity depending on the number of operating units.

2 Claims, 10 Drawing Sheets

| | |
|---|---|
| 1 | outdoor unit |
| 2a , 2b , 2c | Indoor unit |
| 3 | variable frequency compressor |
| 4 | outdoor heat exchanger |
| 5 | four-way valve |
| 6a , 6b , 6c | indoor heat exchanger |
| 7 | liquid main pipe |
| 8a , 8b , 8c | liquid branch pipe |
| 9 | gas main pipe |
| 10a , 10b , 10c | gas branch pipe |
| 11a , 11b , 11c | flow-control valve |
| 17a , 17b , 17c | room temperature sensor |
| 18a , 18b , 18c | operation setting circuit |

| | |
|---|---|
| 101 | outdoor unit |
| 102a , 102b , 102c | Indoor unit |
| 103 | variable frequency compressor |
| 104 | outdoor heat exchanger |
| 105 | four-way valve |
| 106a , 106b , 106c | indoor heat exchanger |
| 107 | liquid main pipe |
| 108a , 108b , 108c | liquid branch pipe |
| 109 | gas main pipe |
| 110a , 110b , 110c | gas branch pipe |
| 111a , 111b , 111c | flow-control valve |
| 117a , 117b , 117c | room temperature sensor |
| 118a , 118b , 118c | operation setting circuit |

| capacity \ mode | | L1 | L2 | L3 | L4 | L5 | L6 | L7 |
|---|---|---|---|---|---|---|---|---|
| 2.0 KW | cooling | 0 | 0.3 | 0.5 | 0.8 | 1.2 | 1.5 | 2.0 |
| | heating | 0 | 0.4 | 0.7 | 1.1 | 1.7 | 2.1 | 2.8 |
| 2.5 KW | cooling | 0 | 0.4 | 0.6 | 1.0 | 1.5 | 1.9 | 2.5 |
| | heating | 0 | 0.5 | 0.9 | 1.4 | 2.2 | 2.7 | 3.6 |
| 3.2 KW | cooling | 0 | 0.5 | 0.8 | 1.3 | 1.9 | 2.4 | 3.2 |
| | heating | 0 | 0.7 | 1.2 | 2.0 | 2.9 | 3.6 | 4.8 |

FIG. 10

(a) Every-room - operation

| Indoor unit | Operation mode | ON-OFF signal | Rated capacity | Differential temperature Ln |
|---|---|---|---|---|
| 2a | cooling | ON | 2.0 | 6 |
| 2b | cooling | ON | 2.5 | 4 |
| 2c | cooling | ON | 3.2 | 5 |

(b) Two-room - operation

| Indoor unit | Operation mode | ON-OFF signal | Rated capacity | Differential temperature Ln |
|---|---|---|---|---|
| 2a | cooling | ON | 2.0 | 6 |
| 2b | cooling | ON | 2.5 | 4 |
| 2c | cooling | OFF | 3.2 | 0 |

(b) Single-room - operation

| Indoor unit | Operation mode | ON-OFF signal | Rated capacity | Differential temperature Ln |
|---|---|---|---|---|
| 2a | cooling | ON | 2.0 | 6 |
| 2b | cooling | OFF | 2.5 | 0 |
| 2c | cooling | OFF | 3.2 | 0 |

FIG. 11

List of Marks in the Drawings 1. outdoor unit
2a. indoor unit
2b. indoor unit
2c. indoor unit
3. variable frequency compressor
6a. indoor heat exchange
6b. indoor heat exchange
6c. indoor heat exchange
7. liquid main pipe
8a. liquid branch pipe
8b. liquid branch pipe
8c. liquid branch pipe
9. gas main pipe
10a. gas branch pipe
10b. gas branch pipe
10c. gas branch pipe
11a. flow-control valve
11b. flow-control valve
11c. flow-control valve
17a. room temperature sensor
17b. room temperature sensor
17c. room temperature sensor
18a. operation setting circuit
18b. operation setting circuit
18c. operation setting circuit

MULTI-ROOM TYPE AIR-CONDITIONER

TECHNICAL FIELD

The present invention relates to a multi-room type air-conditioning system that comprises an outdoor unit and a plurality of indoor units coupling to the outdoor unit, and a conditioning capacity of the air-conditioner is controlled through controlling a compressor capacity.

BACKGROUND ART

A conventional multi-room type air-conditioning system, that comprises one outdoor unit and a plurality of indoor units coupling to the outdoor unit, employs a variable capacity compressor, and controls the variable capacity of the compressor disposed in the outdoor unit responsive to loads requested from the indoor unit.

The above conventional air-conditioning system is detailed hereinafter by referring to the attached drawings.

FIG. 7 depicts a refrigerating cycle of the conventional multi-room type air-conditioning system.

In FIG. 7, a variable frequency compressor 103 driven by an inverter (hereinafter called "compressor"), an outdoor heat exchanger 104, and a four-way valve 105 for selecting functions, i.e., cooling/heating modes, are provided in an outdoor unit 101. Indoor heat exchangers 106*a*, 106*b* and 106*c* are provided in indoor units 102*a*, 102*b* and 102*c* respectively. The outdoor unit 101 is coupled to the indoor units 102*a*, 102*b* and 102*c* with liquid branch pipes 108*a*, 108*b*, and 108*c* as well as gas branch pipes 110*a*, 110*b* and 110*c*, where a liquid main pipe 107 and a gas main pipe 109 are both disposed within the outdoor unit 101, and both the main pipes branch into the above branch pipes. In the liquid branch pipes 108*a*, 108*b* and 108*c*, flow-control valves 111*a*, 111*b* and 111*c* are provided so that valve opening positions can be controlled by pulses using stepping motors. The indoor units 102*a*, 102*b* and 102*c* comprise indoor temperature sensors 117*a*, 117*b* and 117*c* that detect their room temperatures, and operation setting circuits 118*a*, 118*b* and 118*c* with which a user can set an operation mode (cooling or heating), a desirable temperature, start and stop.

A method of controlling a frequency of the compressor in this refrigerating cycle is described hereinafter.

FIG. 8 is a block diagram depicting the controlling process, and FIG. 9 depicts a divisional temperature zone of ΔT, which is a difference between the room temperature Tr and a set temperature Ts.

In the indoor unit 102*a*, first, an output of the indoor temperature sensor 117*a* is fed into a room temperature detection circuit 121, then tapped off therefrom as a temperature signal and fed into a differential temperature calculating circuit 122. On the other hand, the set temperature and the operation mode instructed by the operation setting circuit 118*a* are determined by a setting determination circuit 123, and fed into the differential temperature calculation circuit 122, where a temperature difference ΔT (=Tr−Ts) is calculated and converted into a load number, i.e., value Ln, as shown in FIG. 9, which is taken as a differential temperature signal. For example, in the cooling operation, Tr=27.3° C., Ts=26° C., ΔT=1.3° C. and which makes Ln=6. An ON-OFF recognition circuit 124 recognizes a start (ON) or a stop (OFF) of the indoor unit 102*a*, where the start and stop are set by the operation setting circuit 118*a*. Further, a rated capacity of the indoor unit 102*a* is stored in a rated capacity storing circuit 125. These signals including the rated capacity signal, differential temperature signal, operation mode signal and ON-OFF recognition signal, are fed from a signal transmitting circuit 126 into a signal receiving circuit 127 of the outdoor unit 101. The same signals are fed from the indoor units 102*b* and 102*c* into the signal receiving circuit 127. The signals received in the circuit 127 is fed into a compressor frequency calculation circuit 128.

In the compressor frequency calculation circuit 128, load constants of each indoor unit are taken from a load constant table 130 shown in FIG. 10 using the rated capacity signal, differential temperature signal, operation mode signal and ON-OFF recognition of each indoor unit. A frequency of the compressor 103 is determined through multiplying the sum total of these load constants by a constant which is predetermined through experiments.

The frequency of compressor is thus controlled responsive to the sum total of requested capacity from each room.

This conventional system, however, has the following problems.

The capacity of the compressor is controlled through an easy calculation, such as a linear equation, responsive to load requests from each room, therefore, the capacity of the compressor is not optimally controlled both in an every-room-operation and a single-room-operation, i.e., when the every-room-operation is controlled by a high frequency, the frequency is too high for the single-room-operation. On the other hand, when the frequency is set optimally for the single-room-operation, the every-room-operation is driven by a rather lower frequency and results in a short capacity operation.

The present invention addresses the above problem and aims to realize operations with the best efficiency both in the every-room-operation and the other operations with an optimal frequency of the compressor.

DISCLOSURE OF THE INVENTION

A multi-room air conditioning system of the present invention comprises the following elements:

(a) a variable capacity compressor, (b) an outdoor unit including an outdoor heat exchanger, (c) a plurality of indoor units having an indoor heat exchanger in each unit, (d) a liquid main pipe branching into liquid branch pipes, the liquid main pipe is disposed in the outdoor unit, and mainly coolant liquid flows this main pipe, where the liquid branch pipes couple the outdoor unit with each indoor unit, (e) a gas main pipe branching into gas branch pipes, the gas main pipe is disposed in the outdoor unit, and mainly coolant gas flows this main pipe, where the gas branch pipes couple the outdoor unit with each indoor unit, (f) a flow-control valve which can control a valve opening position, and the valve is disposed in each liquid branch pipe.

The refrigerating cycle is formed by the above elements. In addition to the above elements, there are other elements as follows:

(g) room temperature setting means disposed in each indoor unit, (h) room temperature sensing means disposed in each indoor unit, (i) differential temperature calculation means, disposed in each indoor unit, which figures out the difference between the set room temperature and an actual room temperature, (j) rated capacity store means, disposed in each indoor unit, which stores a rated capacity of respective indoor units, (k) ON-OFF recognition means, disposed in each indoor unit, which recognizes whether the indoor unit is in active (ON) or at inactive (OFF) position, (l) load constant storing means, disposed in each indoor unit, which divides a temperature zone covering a range of possible differential temperatures into a plurality of temperature zones, and determine a load constant for each zone corresponding to each room load responsive to each rated capacity of the indoor units, (m) operating units recognition means for recognizing how many indoor units are ON status by using data obtained from the differential temperature calculation means, rated capacity storing means, ON-OFF recognition means, and load constant storing means, the operating units recognition means calculates a capacity of the compressor at a predetermined cycle responsive to a number of the operating units, (n) compressor capacity control means for controlling the capacity of the compressor based on the calculation result, whereby a control method can be changed according to a number of operating units.

According to the above structure, the present invention provides each indoor unit with (1) the room temperature setting means through which a user can set a desirable room temperature, (2) the room temperature sensing means which detects an actual room temperature, (3) differential temperature calculation means which calculates a difference between the set temperature and the actual room temperature, (4) rated capacity storing means which stores the rated capacity of the respective indoor units, (5) ON-OFF recognition means which recognizes whether each indoor unit is in on mode or off mode, (6) load constant storing means which divides a temperature zone covering a possible temperature range of differential temperatures into a plurality of temperature zones, sets a load constant for each zone corresponding to each room load of the respective rated capacity of each indoor unit, and stores the load constants, (7) compressor capacity control means which recognizes how many indoor units are in operation using the data obtained from the differential temperature calculation means, rated capacity storing means, ON-OFF recognition means and the load constant storing means, determines a calculation method depending on a number of operating units, and controls the capacity of the variable capacity compressor based on the calculation result, whereby the capacity can be controlled optimally both for the every-room-operation and independent-room-operation, thus the indoor units can be operated responsive to loads requested from each room. As a result, the capacity of compressor can be controlled with a high efficiency.

Through the function of the rated capacity, storing means and the ON-OFF determination means, the capacity of the compressor can be controlled optimally both for every-room-operation and independent-room-operation based on the sum total of rated capacities of operating indoor units, therefore, the compressor capacity can be controlled with a high efficiency responsive to the requested load from each room. The control method is easy and can suppress variations of controlling the compressor capacity when a number of operating units changes. When the number of operating units changes, the operation thus becomes stable quickly, i.e., the room can be warmed up instantly.

BRIEF DESCRIPTION OF THE DRAWINGS

FIG. 3(*b*) shows a divided temperature zone when the differential temperature is ΔT in heating mode.

FIG. 10 is a table showing load constants for controlling the compressor capacity according to the present invention.

FIG. 11(*a*)–(*c*) describe examples of controlling the capacity of the compressor of the present invention.

DETAILED DESCRIPTION OF THE EXEMPLARY EMBODIMENTS

The exemplary embodiments of the present invention are described hereinafter by referring to the attached drawings.

(Exemplary Embodiment 1)

Figure 1:
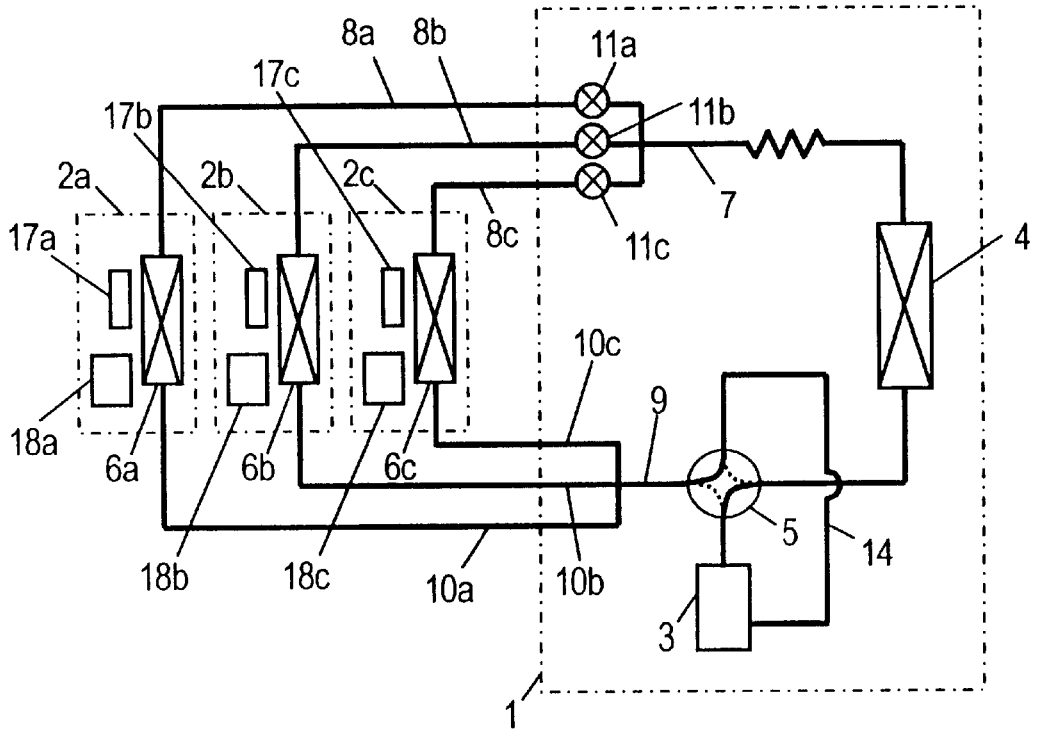
FIG. 1 shows a refrigerating cycle used in a first exemplary embodiment of the multi-room type air-conditioning system according to the present invention.

FIG. 1 shows a refrigerating cycle used in a first exemplary embodiment of the multi-room type air-conditioning system according to the present invention. In this embodiment, three indoor units 2*a*, 2*b* and 2*c* are coupled to an outdoor unit.

In FIG. 1, the outdoor unit 1 comprises a variable frequency compressor 3 that is driven by inverter (hereinafter called just "compressor"), an outdoor heat exchanger 4, a four-way valve 5 for switching the cooling/heating modes. The indoor units 2*a*, 2*b* and 2*c* have indoor heat exchangers 6*a*, 6*b* and 6*c* respectively. The outdoor unit 1 is coupled with the indoor units 2*a*, 2*b* and 2*c* with liquid branch pipes 8*a*, 8*b* and 8*c* as well as gas branch pipes 10*a*, 10*b* and 10*c*. A liquid main pipe is disposed in the outdoor unit 1 and branches into the liquid branch pipes used as above. A gas main pipe is also disposed in the outdoor unit 1 and branches into the gas branch pipes used as above. Flow-control valves 11*a*, 11*b* and 11*c* are disposed in respective liquid branch pipes so that opening positions of the valves can be controlled with pulses produced by stepping motors. The indoor units 2*a*, 2*b* and 2*c* have indoor temperature sensors 17*a*, 17*b* and 17*c*, which detect actual room temperatures of respective rooms where the indoor units are installed, and operation setting circuits 18*a*, 18*b* and 18*c* through which users can set their desirable temperatures, an operation mode (cooling/heating) and ON or OFF.

Next, a method of controlling frequencies of the compressor is detailed.

Figure 2:
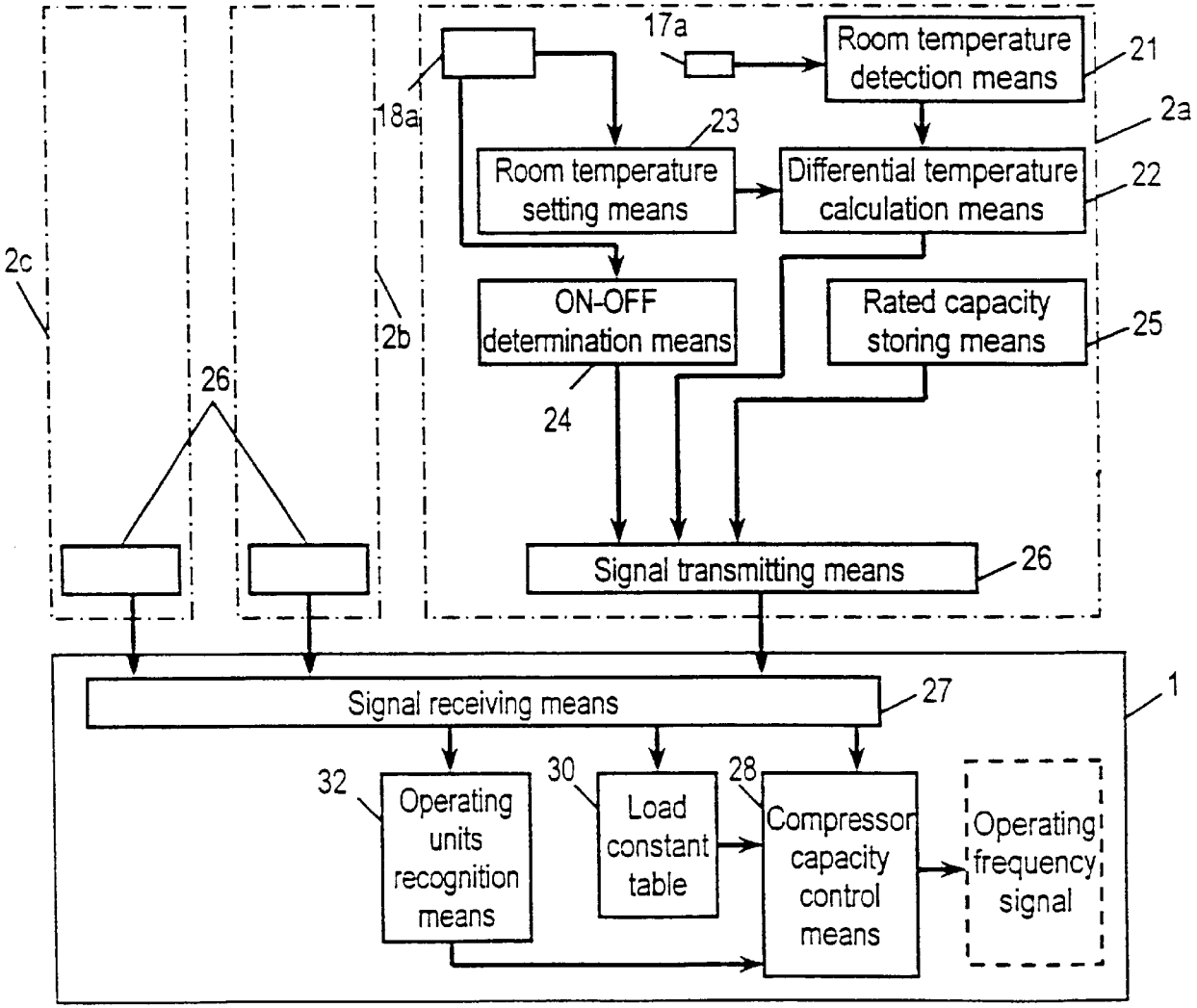
FIG. 2 is a block diagram depicting a control process of compressor frequency of the first exemplary embodiment.
Figure 3:
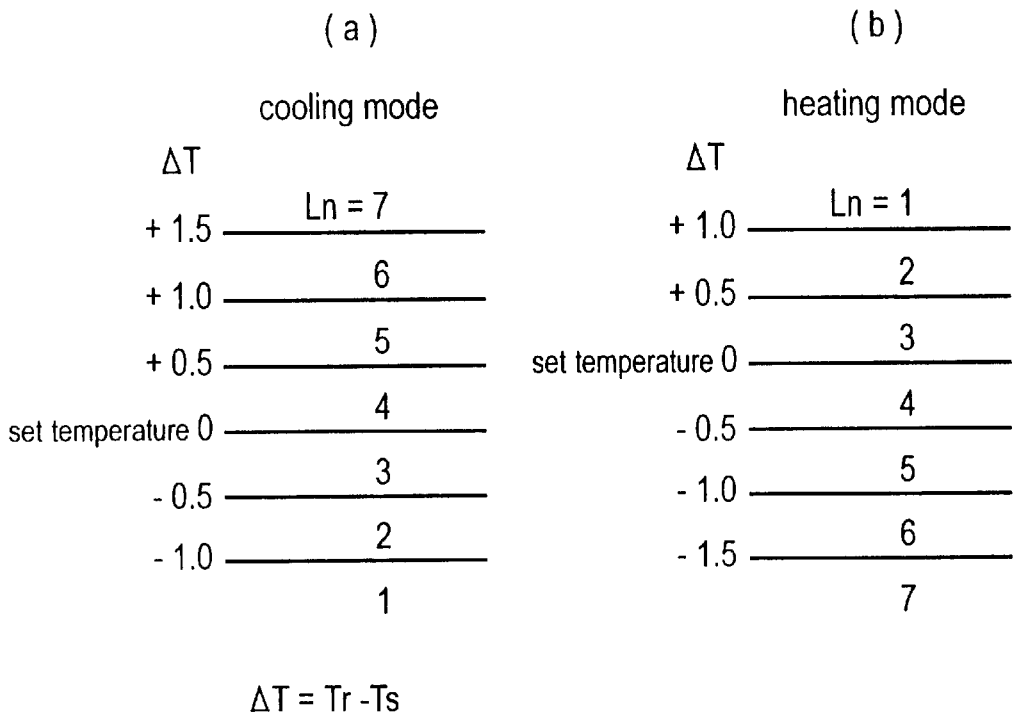
FIG. 3(*a*) shows a divided temperature zone when the differential temperature is ΔT in cooling mode.

FIG. 2 is a block diagram depicting a control process of the compressor frequency of the first exemplary embodiment. FIG. 3 shows a divided temperature zone when the differential temperature is ΔT (room temperature Tr−set temperature Ts.)

First, in the indoor unit 2*a*, an output of the indoor temperature sensor 17*a* is fed into room temperature detection means 21, then tapped off therefrom as a temperature signal and fed into differential temperature calculation means 22. On the otherhand, the set temperature and the operation mode instructed by the operation setting circuit 18*a* are determined by room temperature setting means 23, and fed into the differential temperature calculation means 22, where a temperature difference ΔT (=Tr−Ts) is calculated and converted into a load number, i.e., value Ln, as shown in FIG. 3, which is taken as a differential temperature signal. For example, in the cooling operation, Tr=27.3° C., Ts=26° C., ΔT =1.3° C. and which makes Ln=6. ON-OFF recognition means 24 recognizes a start (ON) or a stop (OFF) of the indoor unit 2*a*, where the start and stop are set by the operation setting circuit 18*a*. Further, a rated capacity of the indoor unit 2*a* is stored in rated capacity storing means 25. These signals including the rated capacity signal, differential temperature signal, operation mode signal and ON-OFF recognition signal are fed from signal transmitting means 26 into signal receiving means 27 of the outdoor unit 1. The same signals are fed from the indoor units 2*b* and 2*c* into the signal receiving means 27. The signals received in the means 27 are fed into compressor capacity control means 28. In the compressor capacity control means 28, a lord constant of each indoor unit are taken from a load constant table 30 shown in FIG. 10 using the rated capacity signal, differential temperature signal, operation mode signal and ON-OFF recognition signal of each indoor unit. A frequency of the compressor 3 is determined through multiplying the sum total of these load constants by a constant. At this time, the constant is changed depending on a number of operating units.

The examples in FIG. 11 are described here, i.e., (a) every-room-operation (2*a*, 2*b* and 2*c* are operated), (b) two-room-operation (2*a* and 2*b* are operated), and (c) singleroom-operation (2*a* only is operated).

In the case of every-room-operation, the load constants of the indoor units 2*a*, 2*b* and 2*c* indicate 1.5, 1.0 and 1.9 in FIG. 11, accordingly the frequency Hz of the compressor 3 is found from the following equation:

$$Hz=A\times(1.5+1.0+1.9)=A\times4.4$$

where A is a constant.

This calculation result is fed into a compressor driving circuit (not shown) as a frequency signal, with which the compressor 3 is controlled. Calculations at a predetermined cycle are performed using the rated capacity signals, differential temperature signal, operation mode signals and ON-OFF recognition signals of respective indoor units 2*a*, 2*b* and 2*c*, and calculation results are fed into the compressor driving circuit (not shown) as frequency signals for controlling the frequency of the compressor 3.

In the case of two-room-operation, the load constants of the indoor units 2*a*, 2*b* and 2*c* indicate 1.5, 1.0 and 0 (zero) in FIG. 10 and FIG. 11. Accordingly, the frequency Hz of the compressor 3 is found from the following equation:

$$Hz=B\times(1.5+1.0+0)=B\times2.5$$

where B is a constant.

In the case of single-room-operation, the load constants of the indoor units 2*a*, 2*b* and 2*c* indicate 1.5, 0 and 0 in FIG. 10 and FIG. 11. Accordingly the frequency Hz of the compressor 3 is found from the following equation.

$$Hz=C\times(1.5+0+0)=C\times1.5$$

where C is a constant.

Figure 4:
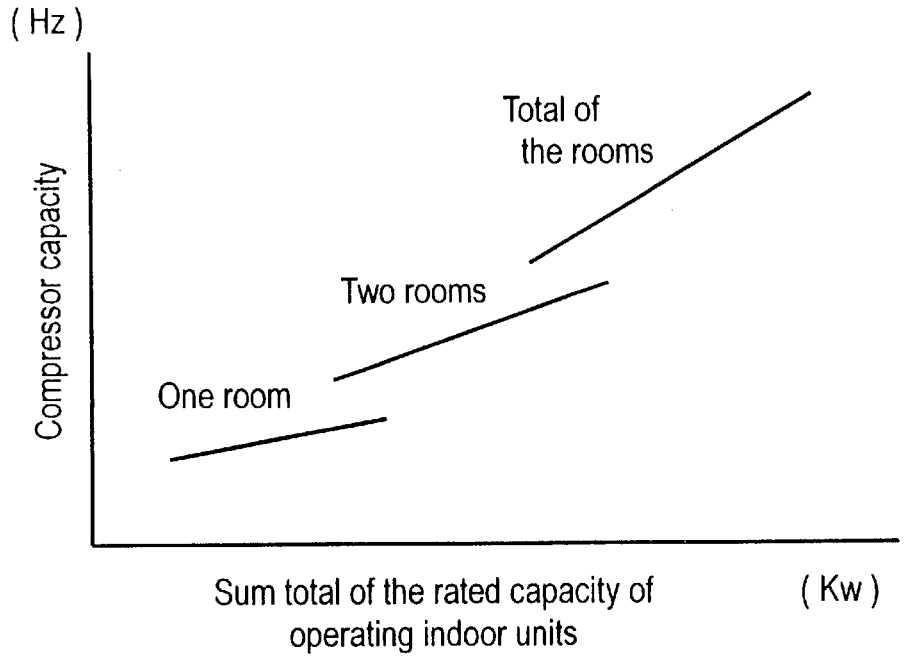
FIG. 4 depicts a relation between the sum total of rated capacity of the indoor unit operated in the first exemplary embodiment and the compressor capacity (operating frequency).

These examples are illustrated in FIG. 4 with curves representing relations between rated capacities of operating indoor units and frequencies of the compressor.

The above description handles substantially the cooling mode; however, the same controlling method can be applied to the heating mode.

As such, since the compressor frequency is controlled responsive to the sum total of the requested capacity from each room as well as a number of operating indoor units, the compressor can be operated optimally and responding to requested load from rooms. The refrigerating cycle can be thus finely controlled responding to the load requested from indoor units, whereby more comfortable air-conditioning and energy saving can be realized.

(Exemplary embodiment 2)

The second exemplary embodiment is described hereinafter by referring to the attached drawings.

The refrigerating cycle used in the second embodiment is the same as used in the first embodiment, therefore, the description is omitted here.

Figure 5:
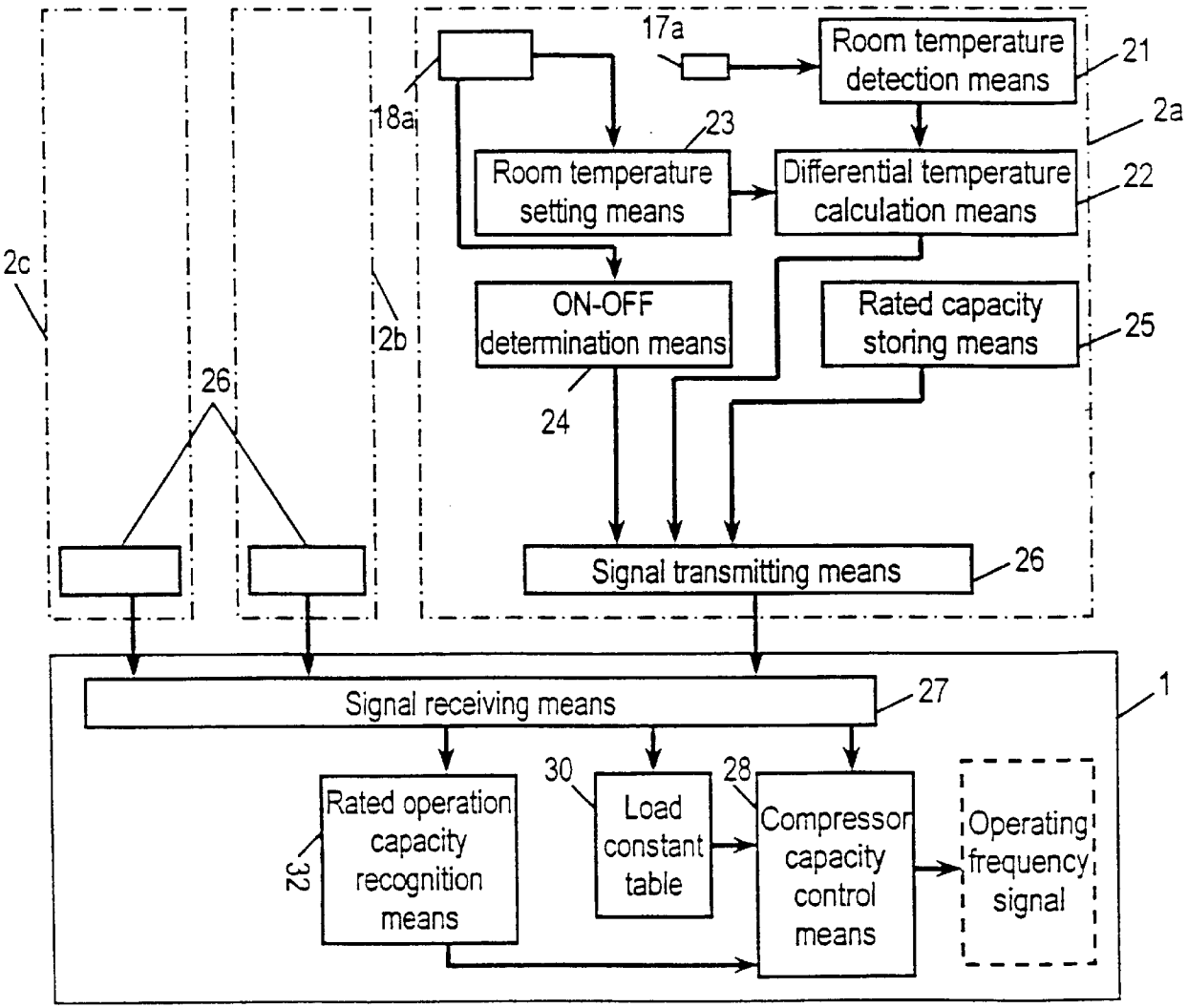
FIG. 5 is a block diagram depicting a control process of the multi-room type air-conditioning system used in the second exemplary embodiment of the present invention.

FIG. 5 is a block diagram depicting a control process of the multi-room type air-conditioning system used in the second exemplary embodiment of the present invention. The difference from FIG. 2 that depicts the control process of the first exemplary embodiment is that this embodiment 2 reads out load constants from FIG. 10, and sum total of the load constant is multiplied by a constant to determine a frequency of the compressor 3.

At this moment, through rated operation capacity recognition means 32, the compressor frequency is calculated responding to a number of operating indoor units, by using the sum total of rated capacities of the operating indoor units. At a transition point in the calculation (one room to two rooms), a calculation method for a fewer operating units is employed, e.g., for two rooms, the calculation method for one room operation is employed.

Figure 6:
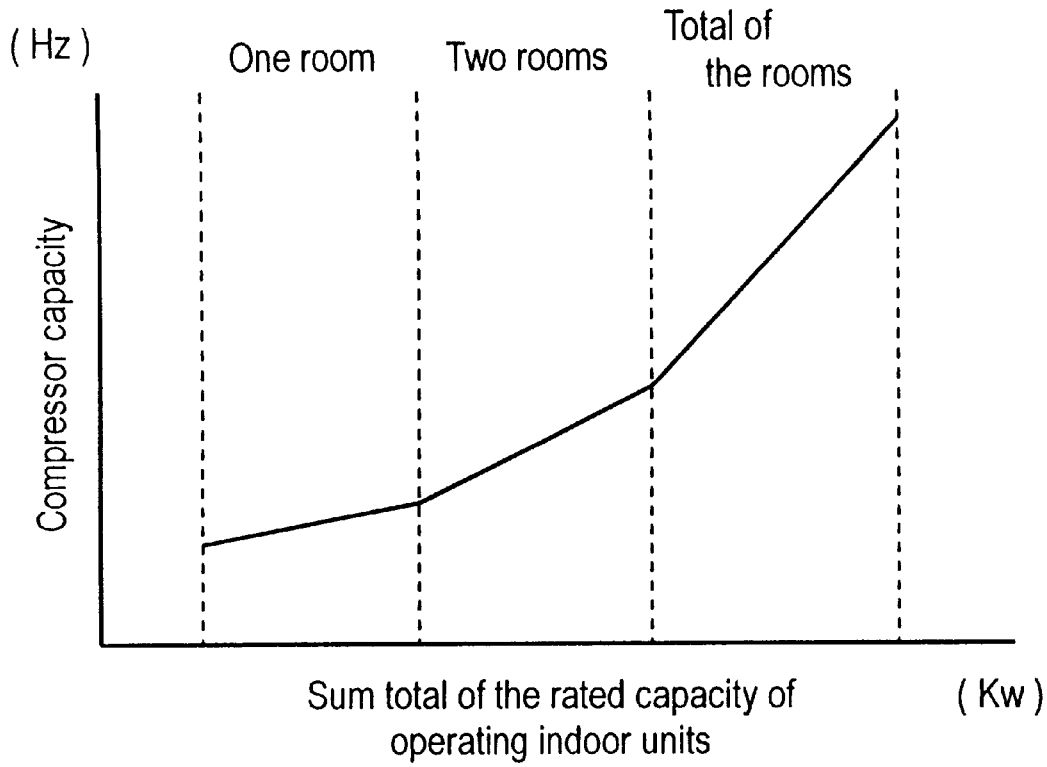
FIG. 6 depicts a relation between the sum total of rated capacity of the indoor unit operated in the second exemplary embodiment and the compressor capacity (operating frequency).
Figure 7:
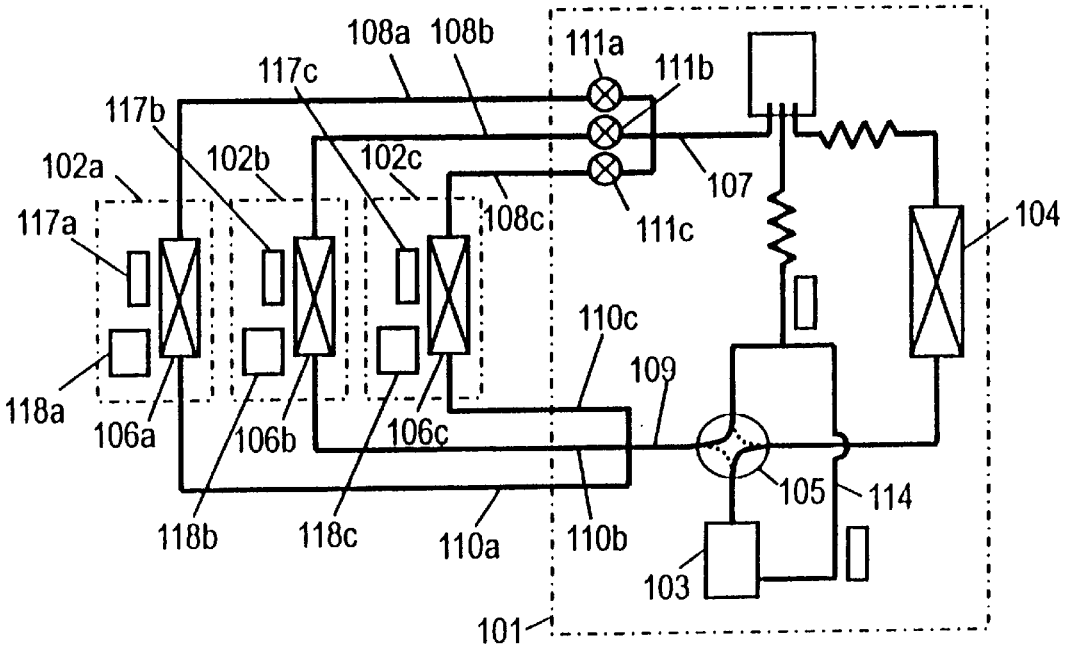
FIG. 7 PRIOR ART
FIG. 7 shows a refrigerating cycle of the conventional multi-room type air-conditioning system.
Figure 8:
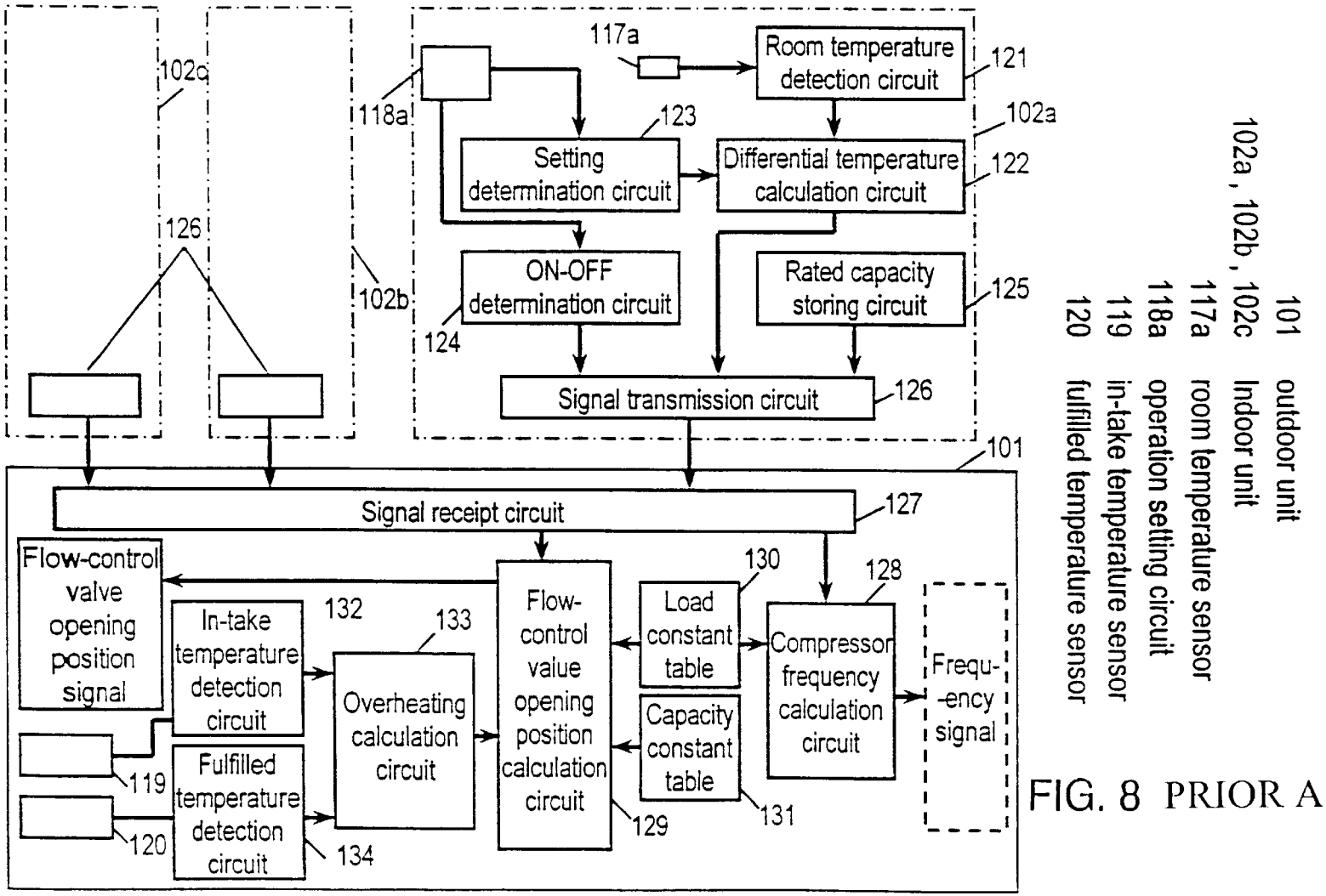
FIG. 8 PRIOR ART
FIG. 8 is a block diagram depicting a control process of the conventional multi-room type air-conditioning system.
Figure 9:
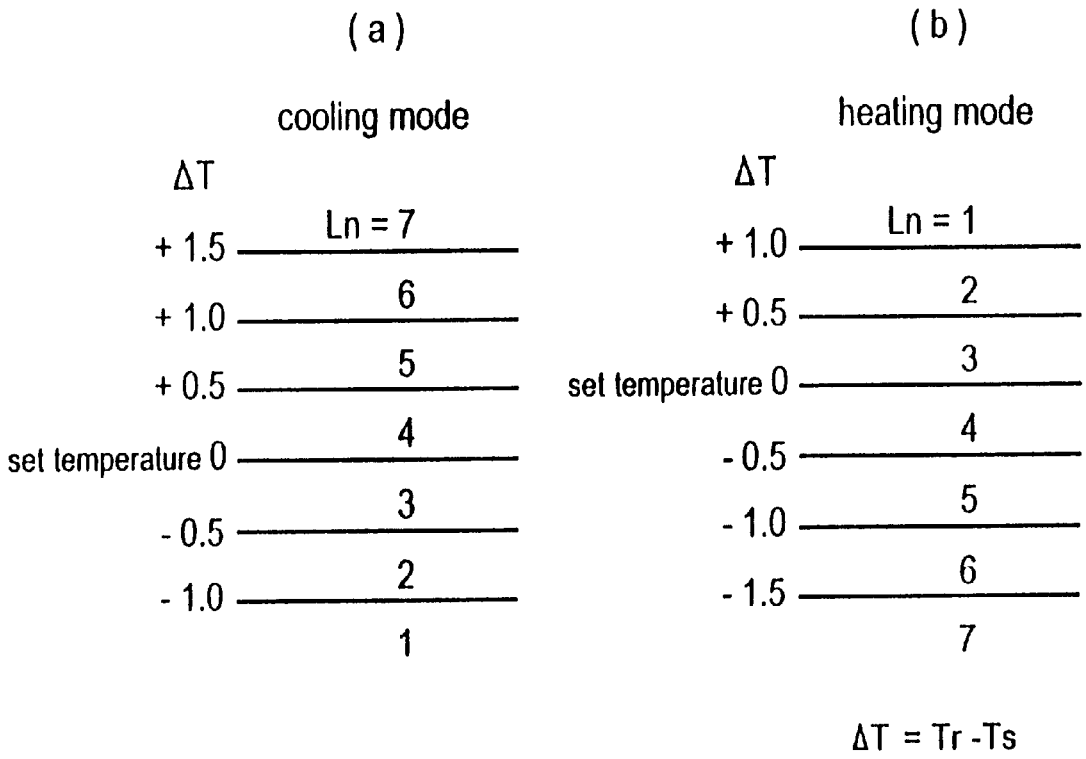
FIG. 9 PRIOR ART
FIG. 9 shows a divided temperature zone when a differential temperature is ΔT in the conventional multi-room type air-conditioning system.

This story is illustrated in FIG. 6 with a curve representing a relation between the sum total of rated capacities and compressor frequencies.

According to FIG. 6, when a sum total of the rated capacities is given, an operating frequency of the compressor is determined. In calculating the frequency of the compressor, the equivalent equations to those used in the first exemplary embodiment can be employed here.

INDUSTRIAL APPLICABILITY

According to the above structure, the present invention provides each indoor unit with (1) the room temperature setting means through which a user can set a desirable room temperature, (2) the room temperature sensing means which detects an actual room temperature, (3) differential temperature calculation means which calculates a difference between the set temperature and the actual room temperature, (4) rated capacity storing means which stores the rated capacity of the respective indoor units, (5) ON-OFF recognition means which recognizes whether each indoor unit is in ON mode or OFF mode, (6) load constants storing means which divides a temperature zone covering a possible temperature range of differential temperatures into a plurality of temperature zones, sets a load constant for each zone corresponding to each room load of the respective rated capacity of each indoor unit, and stores the load constants, (7) compressor capacity control means which recognizes how many indoor units are operated using the data obtained from the differential temperature calculation means, rated capacity storing means, ON-OFF recognition means and the load constant storing means, determines a calculation method depending on a number of operating units, and controls the capacity of the variable capacity compressor based on the calculation result. As such, since the compressor frequency is controlled responsive to the sum total of the requested capacity from each room as well as a number of operating indoor units, the compressor can be operated optimally and responding to requested load from the rooms. The refrigerating cycle can be thus finely controlled responding to the load requested from indoor units, whereby more comfortable air-conditioning and energy saving can be realized.

Through the function of the rated capacity storing means and the ON-OFF recognition means, the capacity of the compressor can be controlled optimally both for every-room-operation and independent-room-operation based on the sum total of rated capacities of operating indoor units, therefore, a highly efficient control on the capacity responsive to the requested load from each room. The control method is easy and can suppress variations of controlling the compressor capacity when a number of operating units changes. When the number of operating units changes, the operation thus becomes stable quickly, i.e., the room can be warmed up instantly.

We claim:

1. A multi-room air-conditioner comprising:

(a) a variable capacity compressor, (b) an outdoor unit including an outdoor heat exchanger, (c) a plurality of indoor units having an indoor heat exchanger in each said indoor unit, (d) a liquid main pipe branching into liquid branch pipes, said liquid main pipe disposed in the outdoor unit and, mainly coolant liquid flowing said main pipe, said liquid branch pipes coupling the outdoor unit with each indoor unit, (e) a gas main pipe branching into gas branch pipes, said gas main pipe disposed in the outdoor unit, and mainly coolant gas flowing this main pipe, said gas branch pipes coupling the outdoor unit with each indoor unit, (f) a flow-control valve controlling a valve opening position, said valve disposed in each liquid branch pipe, whereby a refrigerating cycle is formed, (g) room temperature setting means disposed in each indoor unit, (h) differential temperature calculation means disposed in each indoor unit, and calculating a difference between the set room temperature and an actual room temperature, (i) rated capacity storing means, disposed in each indoor unit, storing a rated capacity of respective indoor units, (j) ON-OFF recognition means, disposed in each indoor unit, recognizing one of the indoor unit status at ON and OFF, (k) load constant storing means, disposed in each indoor unit, dividing a temperature zone covering a possible range of differential temperatures into a plurality of temperature zones, and determining a load constant for each zone corresponding to each room load responsive to each rated capacity of the indoor units, (l) operating units recognition means for recognizing how many indoor units being ON status using data obtained from the differential temperature calculation means, rated capacity storing means, ON-OFF recognition means, and load constant storing means, said operating units recognition means calculating a capacity of the compressor at a predetermined cycle responsive to a number of the operating units, (m) compressor capacity control means for controlling the capacity of the compressor based on the calculation result, thereby changing a control method according to a number of operating units.

2. The multi-room air-conditioner as defined in claim 1, wherein said compressor capacity control means controls the capacity of the compressor based on the sum total of the rated capacities of the plurality of operating indoor units by utilizing the functions of the rated capacity store means and the ON-OFF recognition means.

* * * * *